United States Patent [19]

Brasil

[11] Patent Number: 4,862,650

[45] Date of Patent: Sep. 5, 1989

[54] MODULAR SEAT AND WALKWAY SUPPORT COMPONENTS

[76] Inventor: John G. Brasil, 71 Westlodge Avenue, Toronto, Ontario, Canada

[21] Appl. No.: 159,300

[22] Filed: Feb. 23, 1988

[30] Foreign Application Priority Data

Feb. 23, 1987 [CA] Canada ..... 530381

[51] Int. Cl.[4] ..... E04H 3/12

[52] U.S. Cl. ..... 52/9

[58] Field of Search ..... 52/6–9, 52/637, 638; 182/178, 179

[56] References Cited

U.S. PATENT DOCUMENTS

| | | | |
|---|---|---|---|
| 1,809,598 | 6/1931 | Oberderfer et al. | 52/8 |
| 2,651,081 | 9/1953 | Storer | 52/8 |
| 2,817,121 | 12/1957 | Mackintosh | 52/9 |
| 4,044,523 | 8/1977 | Layher | 182/179 |
| 4,102,087 | 7/1978 | Jarvis | 52/9 |
| 4,106,591 | 8/1978 | Cohen et al. | 182/100 |
| 4,195,451 | 4/1980 | Jarvis | 52/9 |
| 4,587,786 | 5/1986 | Woods | 403/49 |
| 4,602,470 | 9/1986 | Stuart et al. | 52/638 |
| 4,611,439 | 9/1986 | Graham Jr. | 52/9 |

FOREIGN PATENT DOCUMENTS

| | | | |
|---|---|---|---|
| 1159351 | 12/1983 | Canada . | |
| 2551475 | 5/1976 | Fed. Rep. of Germany | 52/9 |

*Primary Examiner*—James L. Ridgill, Jr.

[57] ABSTRACT

A modular tiered seat and walkway support component compatible with a standard scaffolding system is disclosed for use in assembling temporary viewing stands. The backbone of the component is a diagonally oriented rafter which supports a plurality of spaced horizontally extending angle arms for the attachment and support of walkway surfaces. The rafter also supports a plurality of spaced, vertically extending columns which are capped by metal plates to which seating surfaces are attached. The rafter is connected at either end to scaffolding standards by means of a bent plate, a portion of which is centrally bored to engage with the spiggots provided at the top end of the scaffolding standard.

4 Claims, 5 Drawing Sheets

MODULAR SEAT AND WALKWAY SUPPORT COMPONENTS

The invention relates to temporary, multiple tiered spectator seating and viewing stands or bleachers, and is particularly concerned with modular tiered seat and walkway support components which are compatible with standard scaffolding systems such as those forming the subject of U.S. Pat. Nos. 4,044,523 Layher, and 4,587,786, Anthes.

Various systems are known for assembling temporary seating and viewing stands for spectators at outdoor sports events, concerts, and the like, which comprise single-purpose frame-like structures, such as the type illustrated in U.S. Pat. No. 4,102,087.

However there are disadvantages to the known systems. One problem stems from the fact that the seat and walkway supports require a dedicated support structure. To purchase an entire single-purpose seating and viewing stand can be very costly, and furthermore, the stand must be stored when not in use, necessitating a large storage area.

According to the present invention, the drawbacks associated with known temporary seating systems are overcome by providing a modular seat and walkway support component which is compatible with standard scaffolding systems and plank-type seating and walkway members. Such a component also enlarges the number of uses to which standard scaffolding systems may be put, increasing its value and income producing potential.

In drawings which illustrate embodiments of the invention,

Figure 1:
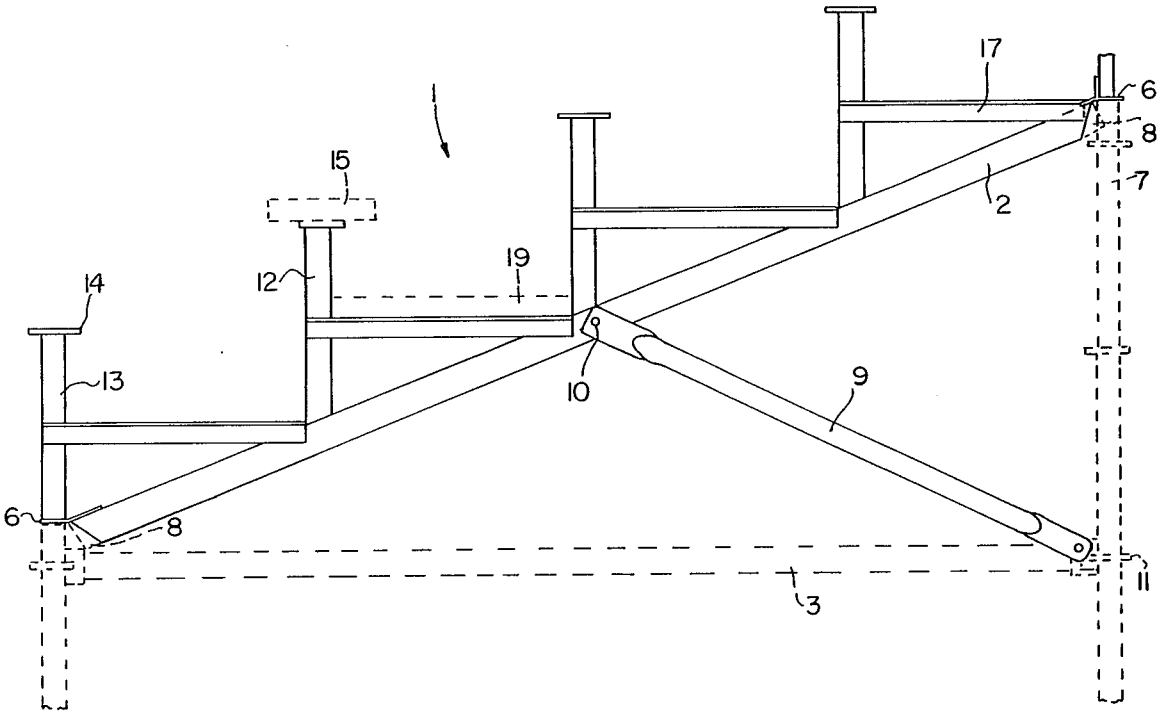
FIG. 1 is an elevation of a first embodiment of the present invention.
Figure 2:
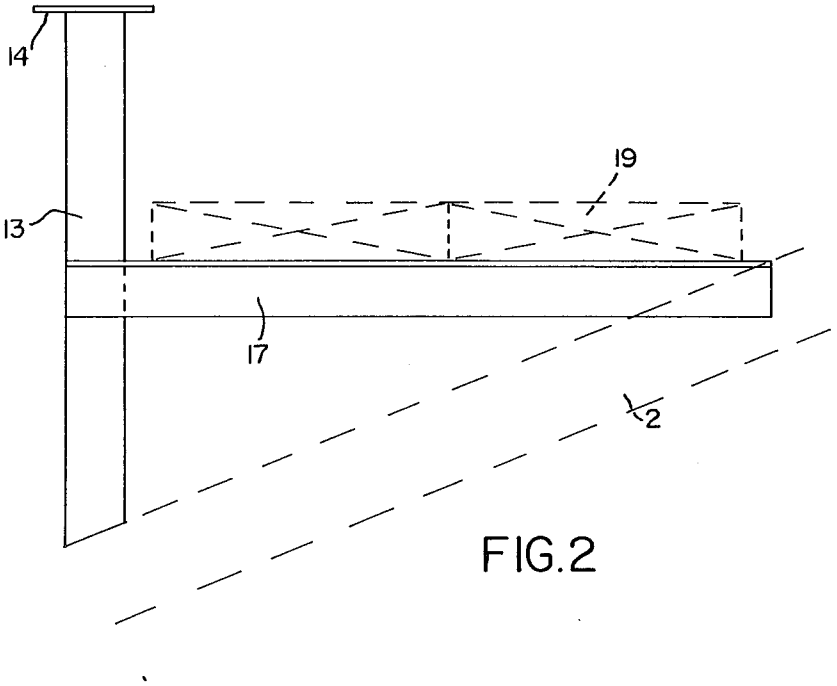
FIG. 2 is a close-up side-view of a representational portion of the embodiment of FIG. 1.

The principal component of the temporary multiple tiered spectator and viewing stands of the present invention is the modular tiered seat and walkway support component. Referring to the drawings, and in particular to FIG. 1, the tiered seat and walkway support component of the present invention is indicated generally at 1. Seat and walkway support component 1 is, basically, a diagonally oriented structural member adapted at each of its upper and lower ends to engage standard scaffolding components without special modifications thereof.

The backbone of the seat and walkway support component 1 is the principal rafter 2 fabricated from, for instance, hollow rectangular steel tubing. Other suitably rigid and workable materials will be apparent to the skilled workman. At each end, principal rafter 2 is adapted for attachment to a standard scaffolding system of the type previously mentioned. Principal rafter 2 is of a length corresponding to the hypotenuse of a right-angled triangle, the base of which is the length of a standard scaffolding ledger (approximately 2 meters) and the height of which is the distance between a selected locking disc of the type described in U.S. Pat. No. 4,587,786, and the top of a scaffold standard (one meter in a typical embodiment). The longitudinal axis of the principal rafter 2 forms an angle with the standard scaffolding ledger 3, which measures from about 22 to about 23, 22.3 in the embodiment illustrated in FIG. 1. An apertured joining plate 6 extends outwardly from the upper surface of each end of the rafter 2, for engagement with the spiggots provided at the top end of each scaffolding standard 7 for vertical stacking thereof. The portions of the joining plates 6 extending beyond the ends of the rafter 2 are bent, forming an angle with the longitudinal axis of the rafter 2, to extend essentially horizontally when the rafter 2 is in the operative position, as illustrated in FIG. 1. The aforementioned spiggots at the upper ends of the scaffolding standards 7 pass through the apertures in the joining plates 6, with the plates then resting on the upper edge of the tubing of the standard 7, to support the rafter 2. As can be seen by the phantom outlines of the ends of the rafters 8, in FIG. 1, it is necessary, when utilizing rectangular tubing in the rafter construction, to remove some of the tubing stock from the rafter 2 opposite the joining plates 6, so that the fit of the rafter 2 with the scaffolding standard 7 is not interferred with by the components of the scaffolding.

As seen in FIG. 1, a diagonal brace member 9 is provided to both ensure the rigidity of the rafter 2, and lock it in place thereby preventing any possible uplift from wind. The brace 9 extends between the mid-point of the rafter 2, where it is attached by a nut and bolt fastener 10, to the scaffolding standard 7 supporting the upper end 8 of the rafter 2. The other end of the brace 9 is secured to a locking disc 11 of the type described in applicant's U.S. Pat. No. 4,587,786 referenced above.

Figure 3:
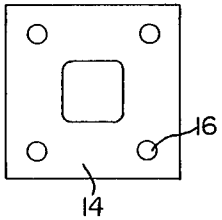
FIG. 3 is a plan view of a seating surface attachment plate for use with the embodiment of FIG. 1.

The rafter 2 supports a plurality of essentially equally spaced, vertically extending columns 12, which may also be of any suitably rigid and workable material, but in the form shown comprise square hollow steel tubing. The columns 12 are secured at their bases to the rafter 2 by welding. An additional vertically extending column 13 is also attached to the rafter 2 by means of the lower joining plate 6. Affixed to the top of each of the columns 12, 13 by welding, is a metal plate 14 which may be of any structurally stable configuration, but in the form shown is a square. Plates 14 provide the support surface to which seating members such as wooden planking 15 (shown in phantom) or the like may be attached. For this purpose, bolt holes 16 are provided, as shown in FIG. 3.

Figure 4:
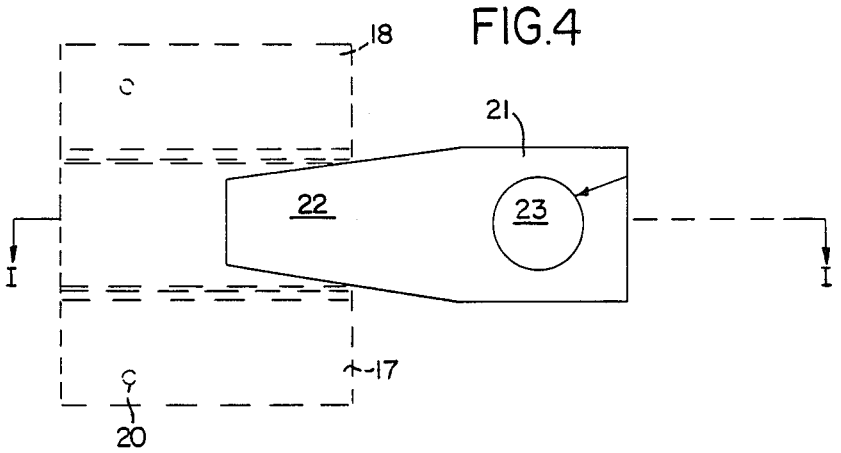
FIG. 4 is a plan view of a joining plate.

Referring again to FIG. 1, a plurality of pairs of angle irons 17, 18 are connected at one end to opposite sides of the column by welding, and are connected at their other end to the corresponding opposite sides of the rafter 2 by welding. The pairs of angle irons 17, 18 extend horizontally, in a step-like manner, from the mid-portion of each column 12, 13 to a location on the sides of rafter 2, adjacent the base of the next column upwards, for the attachment and support of walkway members 19 which may be planks or any other suitable walking surface. Bolt holes 20 are provided for this purpose (See FIG. 4).

The seating members 15 and walkway members 19 referred to above extend horizontally between adjacent tiered seat and walkway support components 1, which are typically spaced apart approximately 2 meters.

Figure 5:
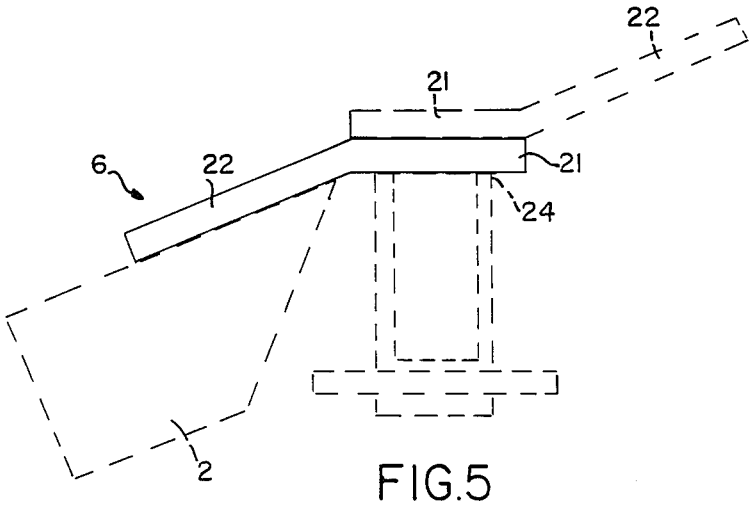
FIG. 5 is a section of the line I—I of FIG. 4.

Referring again to the joining plate 6 described above and shown in FIGS. 4 and 5, it is typically bent metal plate. In the form shown it is provided with a centrally bored rectangular portion 21 integral with a trapezoidal portion 22, but angled thereto. In the form shown the plane of the trapezoidal portion 22 forms an angle of 22.3 with the plane of the horizontal portion 21.

The trapezoidal portions 22 of the plates 6 are connected by welding to the upper surfaces of the ends 8 of rafter 2. The metal plate 6 is adapted to be compatible with a scaffolding standard 7, the end portion or spiggot of which fits through the aperture 23 of the plate 6, which in turn is supported upon the shoulder 24 of the scaffolding standard 7.

As can be seen in FIG. 1, the spiggot of the scaffolding standard 7 supporting the rafter 2 of the present invention at its lower end 8 (via the lower joining plate 6) will be inserted into the lowermost vertical column 13, to ensure maximum rigidity of the system. Moreover, the spiggot of the standard 7 supporting the upper end 8 of the rafter 2 will be inserted into the lowermost column 13 of the next modular tiered seat and walkway support component 1.

Figure 6:
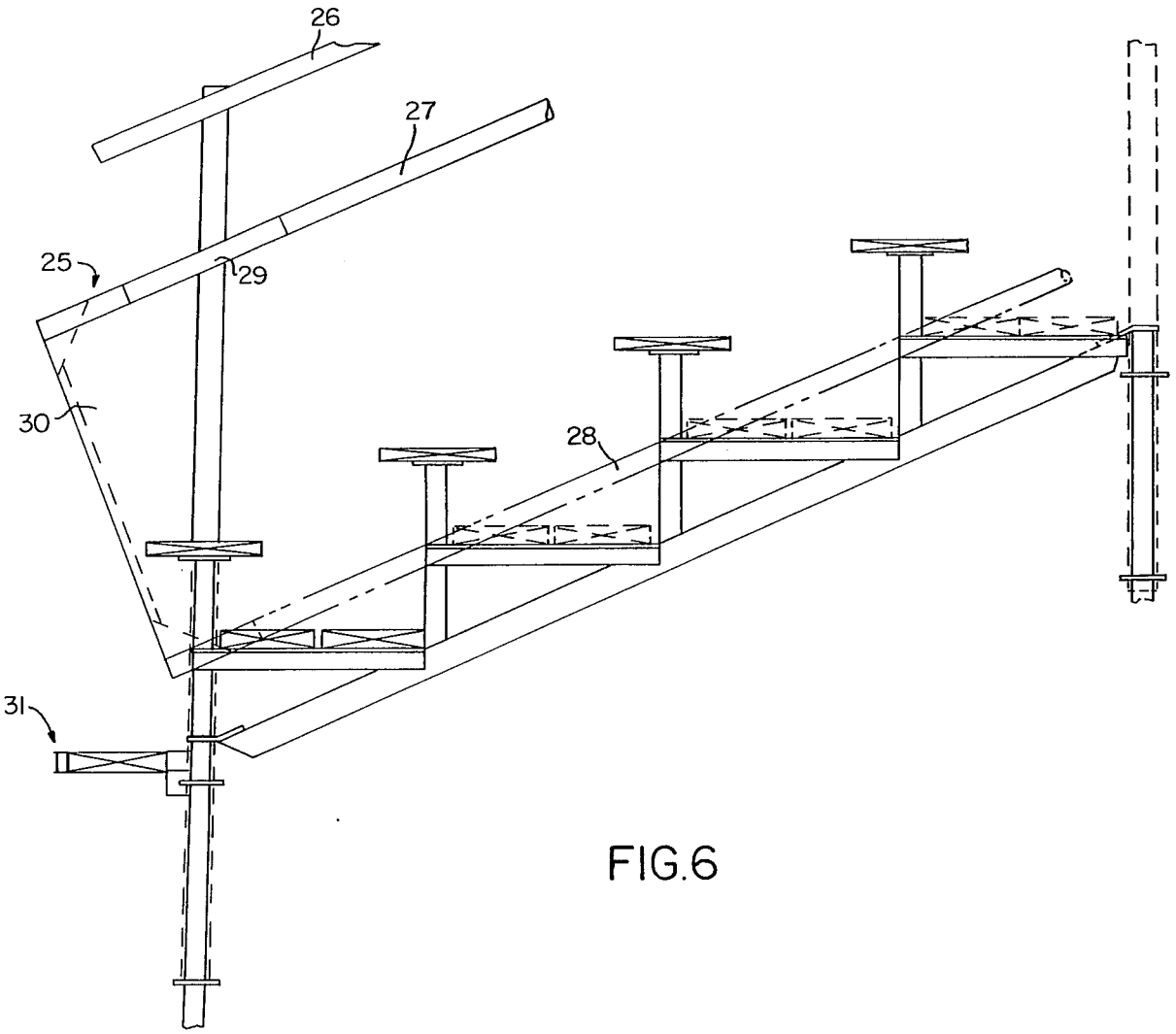
FIG. 6 is an elevation of a second embodiment having a safety fence attached thereto.

In the embodiment shown in FIG. 6, there is a handrail and safety fence shown generally at 25 attached to the tiered seat and walkway support component 1. The fence protects viewers from falling off the viewing stand. The handrail 26 and horizontal fence support members 27 and 28 may be of any suitably rigid fencing material, but in the form shown comprise aluminum tubing, which is fastened to the vertical scaffolding standards by means of U-bolts 29. The wire mesh safety fence material 30 is fastened to the horizontal fence support members 27 and 28.

Figure 7:
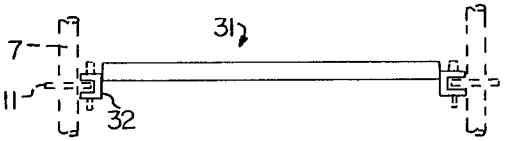
FIG. 7 is a front view of an aisle foot planking ledger.

FIG. 7 illustrates an aisle foot planking ledger indicated generally at 31 which supports the lowermost plank-type walkway surface of an assembled seating and viewing stand.

Figure 8:
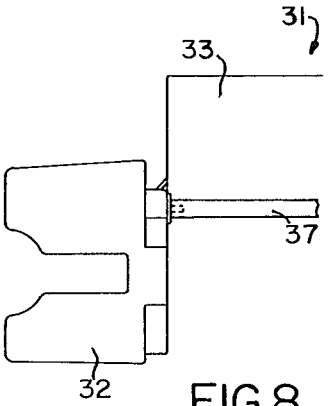
FIG. 8 is a close-up side-view of the end portion of the aisle foot planking ledger.

Each end of the aisle foot planking ledger 31 is provided with a shoe or ledger head 32 which interlocks with the known locking disc 11 fast on a scaffolding standard 7. FIG. 8 is a close-up side view of the end portion, with ledger head 32 of the aisle foot planking ledger 31.

Figure 9:
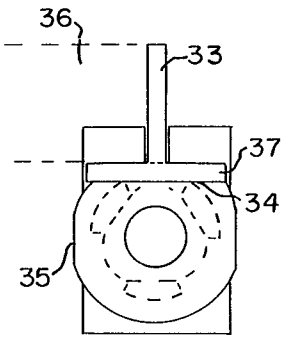
FIG. 9 is a cross-section of the aisle foot planking ledger.

As can be seen from FIG. 9, the aisle foot planking ledger 31 comprises an inverted T beam 33 welded to the flattened upper surface 34 of the ledger head 32. The sides 35 of the ledger head have also been flattened. Plank type walking surfaces 36 (shown in phantom) may be attached to the arms 37 of the inverted T beam 33 by bolts or screws (not illustrated).

It will be understood that the above description is for illustrative purposes, and is not meant to limit the scope of the present invention, which is to be construed only according to the appended claims.

I claim:

1. Modular tiered seat and walkway support components compatible with an assembled scaffolding system presenting laterally extending rows of vertical standards of progressively taller height from a front row thereof to a rear row, a spiggot extending upwardly from the upper end of each of said standards of said scaffolding system, each said modular tiered seat and walkway component comprising:

a rafter element having an upper end and a lower end;

an upper joining means integral with the upper end of said rafter and cooperable with the spiggot of an upper one of said standards for permitting support of the upper end of said rafter by said upper standard;

a lower joining means integral with said lower end of said rafter and cooperable with the spiggot of a lower of said standards for permitting support of said lower end of said rafter by said lower standard; and a plurality of horizontal walkway support members and vertical seat support members, each walkway support member extending from said rafter forwardly to one said vertical seat support member, and each said vertical seat support member extending from said rafter upwardly to a plate member, said walkway support member being joined to said seat support member below the respective plate thereof, the lowermost of said vertical seat support members in each said component being vertically aligned with the lower joining means to cover the spiggot of said lower standard when said lower joining means is in engagement with the spiggot of said lower standard, whereby in an assembly of said components onto a scaffolding system, from lower components to upper components, emplacement of each said component leaves an upper spiggot exposed, and whereby emplacement of the next upwardly situated component encloses the spiggot left exposed by the previous component and securely retains the previously situated and lower component in place on said scaffolding system.

2. A modular tiered seat and walkway support component as claimed in claim 1, wherein said vertical seat support members comprise box columns, said upper and lower joining means of each said component each comprising plates bored to fit over the respective spiggots and to rest on the upper end of the respective standards of said scaffolding system, the lowermost of said box columns extending upwardly from said lower joining means.

3. A modular tiered seat and walkway support component as in claim 2 wherein said horizontal walkway support members comprise pairs of angle irons extending between said rafter and said box columns.

4. A modular tiered seat and walkway support component as claimed in claim 3, wherein said box columns have a substantially rectangular cross section.

* * * * *